US009528250B2

(12) United States Patent
Nelson et al.

(10) Patent No.: US 9,528,250 B2
(45) Date of Patent: Dec. 27, 2016

(54) HOSE WEIGHT FOR A FAUCET

(71) Applicant: Delta Faucet Company, Indianapolis, IN (US)

(72) Inventors: Alfred C. Nelson, Westfield, IN (US); Jeffrey L. Moore, Frankfort, IN (US)

(73) Assignee: Delta Faucet Company, Indianapolis, IN (US)

( * ) Notice: Subject to any disclaimer, the term of this patent is extended or adjusted under 35 U.S.C. 154(b) by 23 days.

(21) Appl. No.: 14/502,353

(22) Filed: Sep. 30, 2014

(65) Prior Publication Data

US 2016/0090719 A1 Mar. 31, 2016

(51) Int. Cl.
*E03C 1/04* (2006.01)

(52) U.S. Cl.
CPC ..... *E03C 1/04* (2013.01); *E03C 2001/0415* (2013.01); *Y10T 137/6951* (2015.04)

(58) Field of Classification Search
CPC ..... Y10T 137/6951; E03C 2001/0415; A63B 69/3638
USPC ..... 473/256
See application file for complete search history.

(56) References Cited

U.S. PATENT DOCUMENTS 2,608,409 A 8/1952 Pinkerton
3,648,324 A 3/1972 Stradella et al.
3,716,239 A 2/1973 Goudreau
3,971,559 A 7/1976 Diforte, Jr.
4,218,057 A * 8/1980 Wilson ..... A63B 21/072 482/109
4,260,150 A 4/1981 Tabet
4,827,538 A 5/1989 Heimann et al.
5,090,062 A 2/1992 Hochstrasser
5,093,942 A 3/1992 Lang
5,095,554 A 3/1992 Gloor
5,188,791 A * 2/1993 Thiery ..... B29C 33/38 106/38.2
5,302,165 A * 4/1994 Caruthers ..... A63B 21/0605 482/108
5,311,909 A 5/1994 Adcock
5,312,314 A * 5/1994 Stephan ..... A63B 21/0602 482/106
5,361,431 A 11/1994 Freier et al.
5,460,378 A 10/1995 Getts
5,575,424 A 11/1996 Fleischmann
5,771,934 A 6/1998 Warshawsky
5,897,469 A * 4/1999 Yalch ..... A63B 15/00 473/256
5,960,832 A 10/1999 Warshawsky
6,068,380 A 5/2000 Lynn et al.
6,250,338 B1 6/2001 Dempsey
6,460,570 B1 10/2002 Jones et al.
6,757,921 B2 7/2004 Esche
6,807,691 B1 10/2004 Hertz
6,915,817 B2 7/2005 Benstead et al.
(Continued)

OTHER PUBLICATIONS

Branson Ultrasonics Corporation, Part Design for Ultrasonic Welding, 2013, 8 pages.

(Continued)

*Primary Examiner* — Kevin Murphy
(74) *Attorney, Agent, or Firm* — Faegre Baker Daniels LLP

(57) ABSTRACT

A hose weight for use with a faucet outlet hose fluidly coupled to a dispensing unit. The hose weight includes an outer housing defining a chamber and a filler received within the chamber.

20 Claims, 8 Drawing Sheets

(56) References Cited

U.S. PATENT DOCUMENTS

| | | | | |
|---|---|---|---|---|
| 7,143,780 | B1 | 12/2006 | Pitts | |
| 7,191,475 | B1 | 3/2007 | Marcotte | |
| 8,038,585 | B1 * | 10/2011 | Brown, Jr. | A63B 21/0004 482/108 |
| 2003/0027656 | A1 * | 2/2003 | Katsuya | A63B 15/00 473/226 |
| 2003/0224867 | A1 * | 12/2003 | Ota | A63B 15/00 473/256 |
| 2004/0010848 | A1 | 1/2004 | Esche | |
| 2004/0216789 | A1 | 11/2004 | Benstead et al. | |
| 2005/0245324 | A1 * | 11/2005 | Light | A63B 69/3638 473/256 |
| 2005/0279676 | A1 | 12/2005 | Izzy et al. | |
| 2009/0145492 | A1 | 6/2009 | Thomas et al. | |
| 2012/0302380 | A1 * | 11/2012 | Erkkinen | A63B 69/3638 473/437 |

OTHER PUBLICATIONS

Sonics & Materials, Inc., Joint Designs for Ultrasonic Welding, 2011, 4 pages.

* cited by examiner

HOSE WEIGHT FOR A FAUCET

BACKGROUND AND SUMMARY

Faucets including a pull-out dispensing unit, such as a spout sprayhead or a side spray, generally utilize a retractor, such as a weight or a spring, to help retract a hose back into a rest position after the dispensing unit has been removed from its docking station by the user. The hose typically extends below the mounting surface of the faucet behind the sink. More particularly, the hose travels from the faucet valve above the mounting surface, loops down and returns back above to attach to the dispensing unit.

If a weight is used as a hose retractor, it is generally attached to the hose using some sort of clamp. By clamping the weight to the hose, the effective length of the hose is shortened if the weight is placed on the portion of the hose past the loop (generally the bottom), closest to the sprayhead, or is ineffective over the final portion of the travel if placed before the loop (generally the bottom), closest to the valve. As an alternative, a sliding weight as a hose retractor provides a substantially constant force on the hose independent of dispensing unit position since the sliding weight is always located near the bottom of the loop due to gravity. Generally, the sliding weight is more efficient if the coefficient of friction between the hose and the weight is as small as possible and the mass of the weight is as great as possible. The contact surface of the weight generally should be corrosion resistance. Cost constraints on designs and material weight are often competing factors.

According to an illustrative embodiment of the present disclosure, a hose weight for use with a faucet outlet hose fluidly coupled to a dispensing unit includes an outer housing having a shell. The shell includes an outer wall, an inner wall, a first end wall, and a chamber defined between the outer wall, the inner wall, and the first end wall. A cap is secured to the shell and defines a second end wall. A filler is received within the chamber, the filler comprising a granular material having grains each with a major dimension of between 0.005 inches and 0.079 inches.

According to another illustrative embodiment of the present disclosure, a hose weight for use with a faucet outlet hose fluidly coupled to a dispensing unit includes an outer housing having a shell formed of a polymer. The shell includes a cylindrical outer wall, a cylindrical inner wall, a first end wall, and an annular chamber defined between the cylindrical outer wall, the cylindrical inner wall and the first end wall. The inner wall defines a passage for slidably receiving a faucet hose. A cap formed of a polymer is secured to the shell and defines a second end wall. The cap includes a center opening aligned with the passage defined by the inner wall. The polymer of the outer housing has a density of between 0.03 lbs. per cubic inch and 0.09 lbs. per cubic inch. A filler is received within the chamber and comprises a metallic material having a density between 0.09 lbs. per cubic inch and 0.37 lbs. per cubic inch.

Additional features and advantages of the present invention will become apparent to those skilled in the art upon consideration of the following detailed description of the illustrative embodiments exemplifying the best modes of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
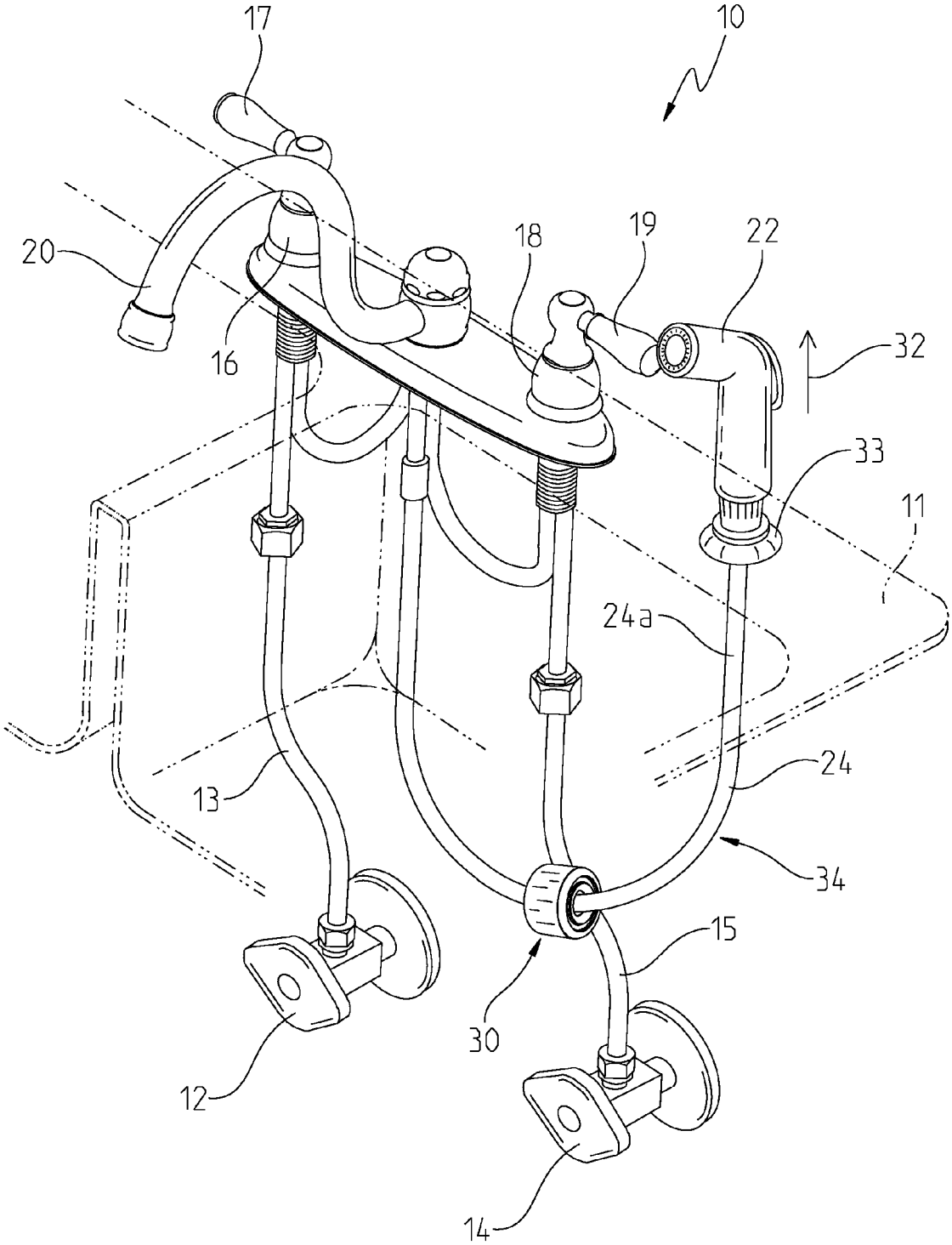
FIG. 1 is a perspective view of an illustrative faucet assembly mounted to a sink deck and including an illustrative hose weight slidably mounted on a hose for a side spray releaseably coupled to the sink deck.

Referring initially to FIG. 1, an illustrative faucet assembly 10 is shown mounted to a sink deck 11 and fluidly coupled to hot water and cold water supplies, illustratively conventional hot and cold water stops 12 and 14, through risers or supply lines 13 and 15, respectively. As is known, conventional hot and cold water control valves 16 and 18 are coupled to handle 17 and 19, respectively, and control the flow water from the supply lines 13 and 15 to an outlet, typically either a delivery spout 20 or a dispensing unit, such as a side sprayer 22. A conventional diverter (not shown) may be utilized to toggle mixed water output to either the delivery spout 20 or the side sprayer 22. A flexible outlet conduit or hose 24 fluidly couples the side sprayer 22 to the control valve 16 and 18.

An illustrative retractor or hose weight 30 is slidably mounted on the hose 24 and is configured to help retract the hose 24 back into the rest position shown in FIG. 1 after the side sprayer 22 has been removed upwardly by the user away from the sink deck 11 (in the direction of arrow 32). In the embodiment of FIG. 1, the side sprayer 22 is in a rest or docked position when releaseably coupled to a docking station 33 supported on the sink deck 11. Due to gravity, the retractor 30 tends to rest at a lower portion of a loop 34 defined by the hose 24 when the side sprayer 22 is in the rest position.

Figure 2:
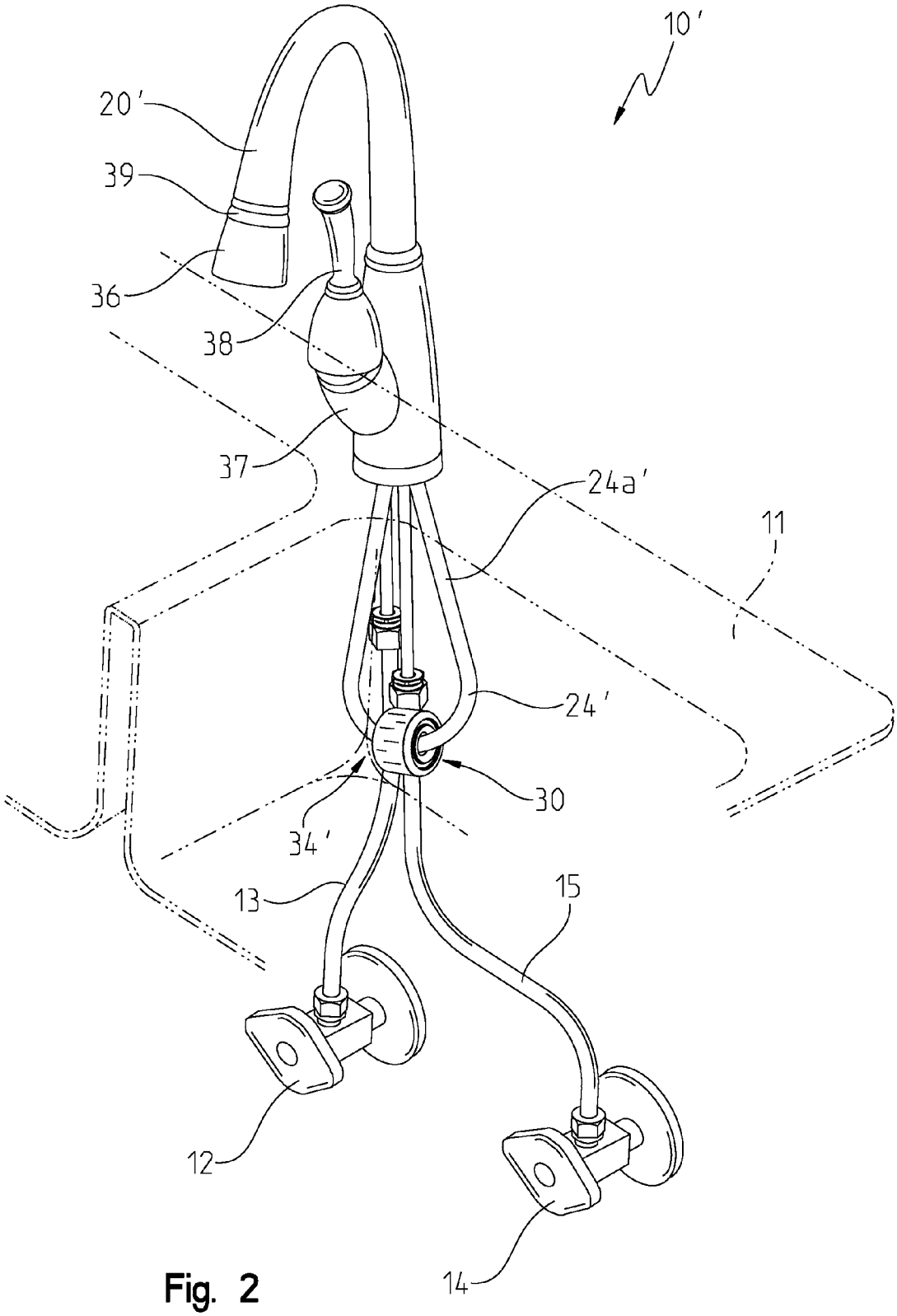
FIG. 2 is a perspective view similar to FIG. 1, showing a further illustrative faucet assembly mounted to the sink deck and including the illustrative hose weight slidably mounted on a hose for a pull-out sprayhead releaseably coupled to a delivery spout.

FIG. 2 illustrates a further illustrative faucet assembly 10' mounted to a sink deck 11. The faucet assembly 10' of FIG. 2 includes a dispensing unit, such as a pull-out sprayhead 36 releaseably coupled to the delivery spout 20'. More particularly, the pull-out sprayhead 36 is fluidly coupled to a mixing valve 37 to receive mixed water outflow therefrom. As is known, the mixing valve 37 is coupled to a handle 38 and controls the flow of water from the supply lines 13 and 15 to the sprayhead 36. A flexible outlet conduit or hose 24' couples the mixing valve 37 to the pull-out sprayhead 36. As with the faucet assembly 10 of FIG. 1, the hose weight 30 is slidably received on the outlet hose 24' and tends to rest at a lower position of the loop 34' defined by the hose 24' when the sprayhead 26 is in the rest or docked position. In the embodiment of FIG. 2, the pull-out sprayhead 36 is in a rest position when releaseably coupled to a docking station 39 supported by the outlet of the delivery spout 20'. The pull-out sprayhead 36 is in an undocked or released position when it is pulled by a user downwardly away from the docking station 39.

In both FIGS. 1 and 2, the material, relative dimensions and resulting weight of the hose weight 30 are selected to assist in retracting the dispensing unit 22, 36, and connected hose 24, 24' from a use position in spaced relation to the respective docking station 33, 39 to a rest position coupled to the docking station 33, 39. Illustratively, the hose weight 30 has a weight greater than the weight of the dispensing unit 22, 36, and the weight of the portion 24*a*, 24*a*' of hose 24, 24' extending between the hose weight 30 at the rest position and the dispensing unit 22, 36, including water contained therein.

The outlet hose 24, 24' may be constructed in any conventional manner, including use of a polymer. In one illustrative embodiment, the outlet hose 24, 24' comprises a cross-linked polyethylene (PEX). In still other illustrative embodiments, the outlet hose 24, 24' may comprise a polymer and/or composite liner surrounded by a covering (not shown), such as a protective sleeve or braiding. The protective sleeve may be formed of conventional materials, such as metal or polymeric fibers. Illustratively, the outlet hose 24, 24' has an outer diameter of approximately 0.48 inches (approximately 1.219 centimeters).

Figure 3:
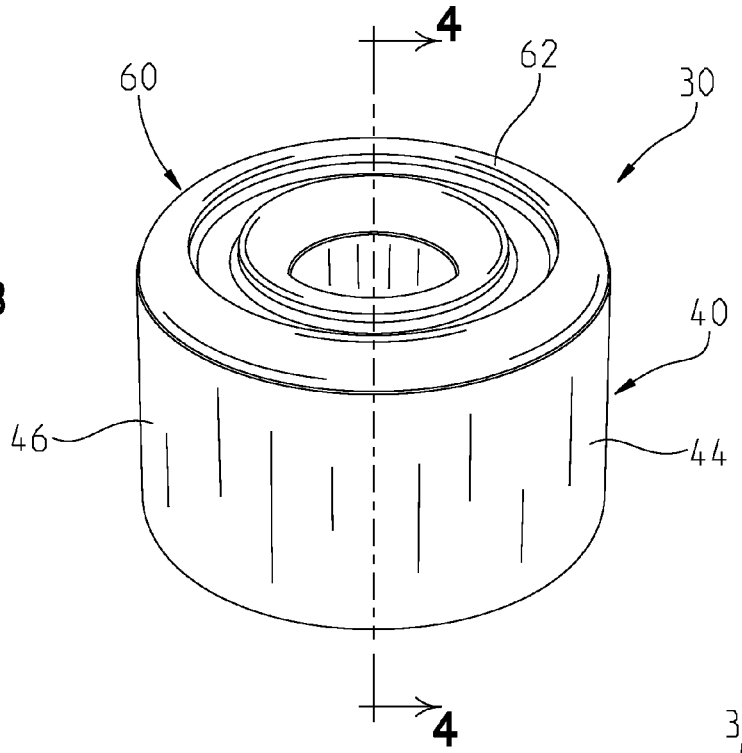
FIG. 3 is a perspective view of the illustrative hose weight of FIGS. 1 and 2.
Figure 4:
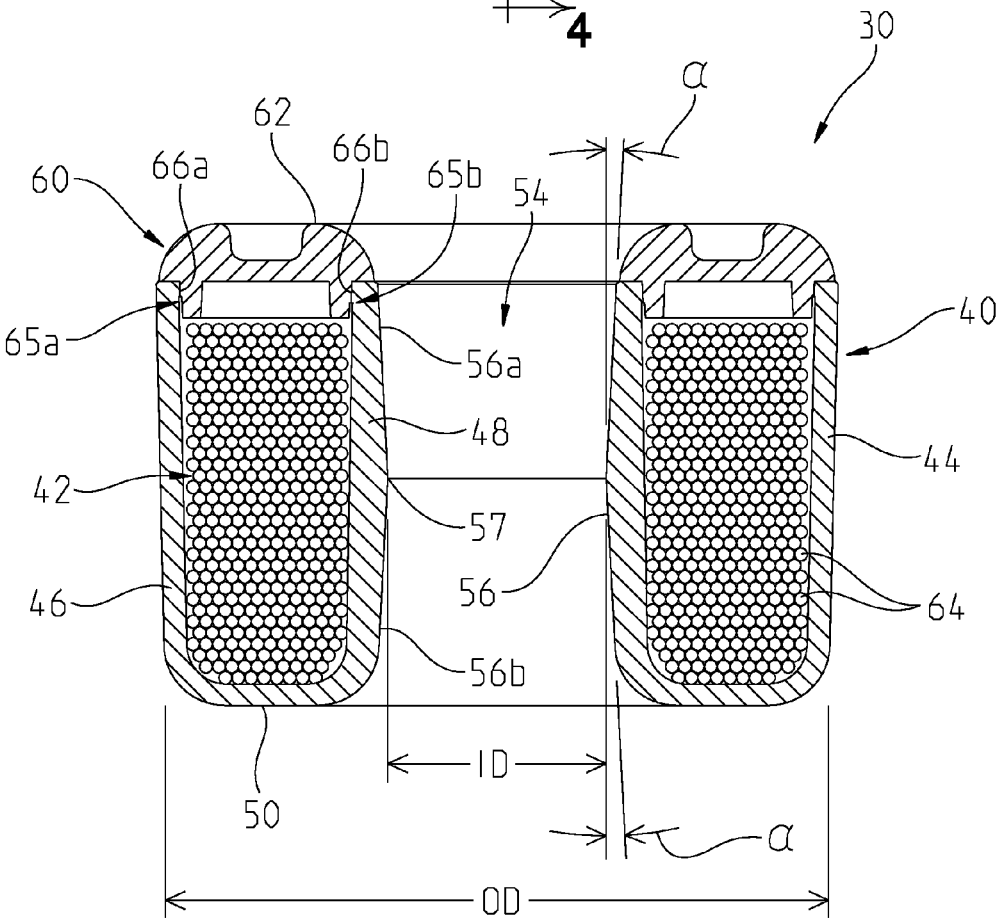
FIG. 4 is a cross-sectional view taken along line 4-4 of FIG. 3.
Figure 5:
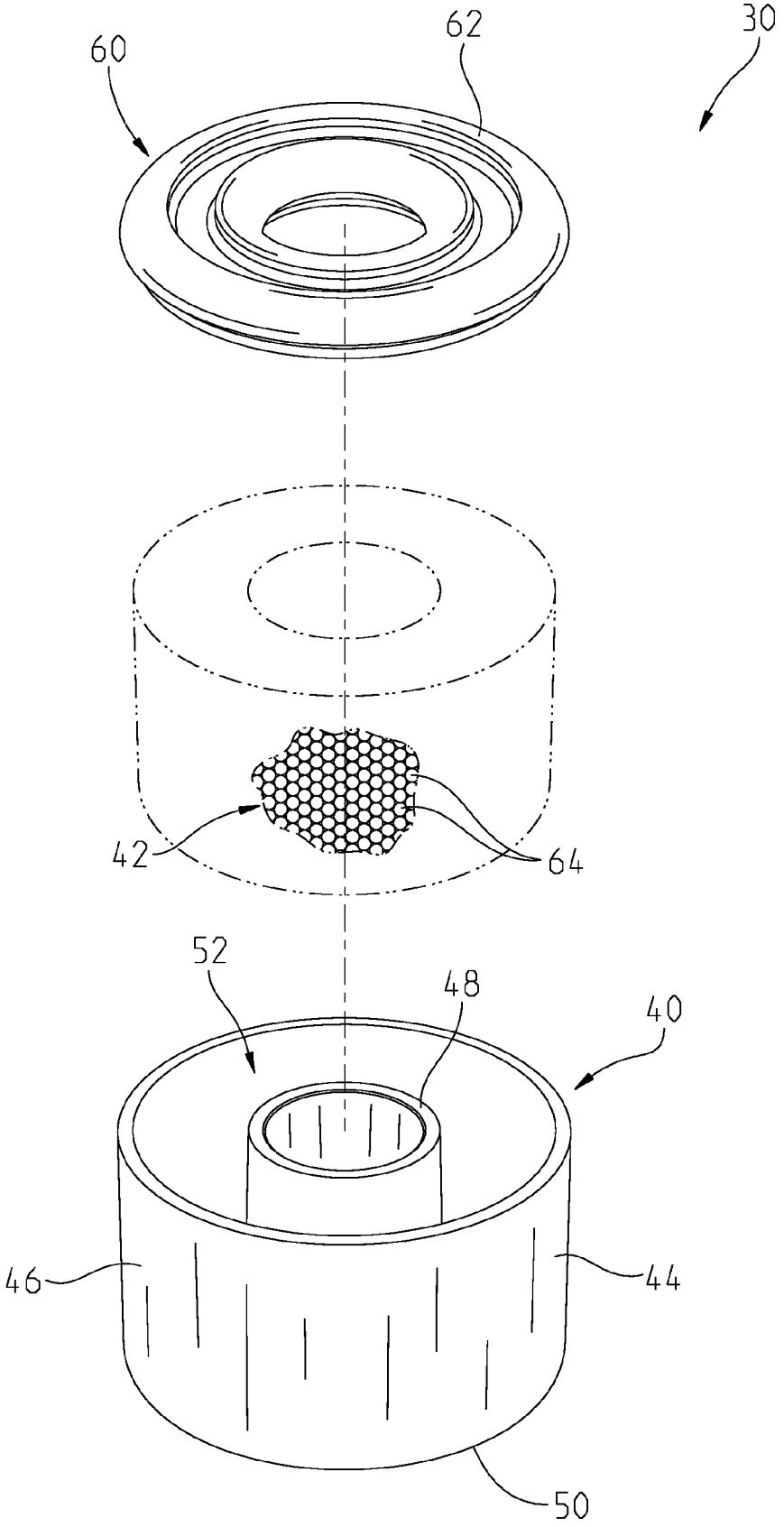
FIG. 5 is an exploded top perspective view of the hose weight of FIG. 3.
Figure 6:
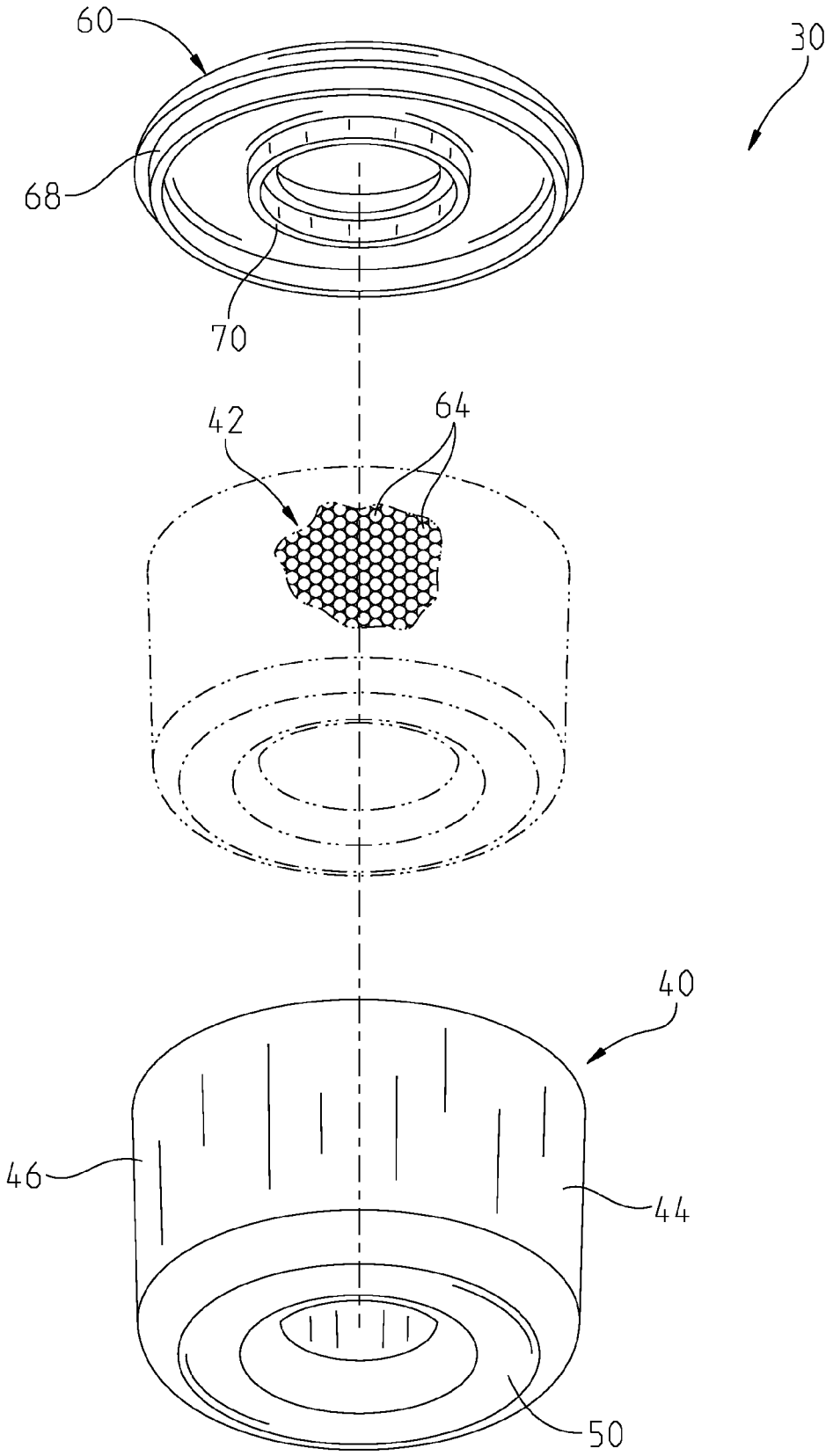
FIG. 6 is an exploded bottom perspective view of the hose weight of FIG. 3.

With further reference to FIGS. 3-5, the illustrative hose weight 30 includes an outer housing 40 and a filler 42. The outer housing 40 includes a shell 44 illustratively formed of a polymer, although other suitable materials such as metals (e.g., stamped aluminum) may be substituted therefor. The shell 44 includes a cylindrical outer wall 46 and a cylindrical inner wall 48 concentrically received radially inwardly from the outer wall 46. A first end wall 50 connects lower ends of the outer and inner walls 46 and 48. A toroidal chamber 52 is defined between the outer wall 46, the inner wall 48 and the first end wall 50. The filler 42 is received within the chamber 52.

The outer wall 46 illustratively has an outer diameter (OD) of between approximately 2 inches and 2.5 inches, while the inner wall 48 illustratively has an inner diameter (ID) of between approximately 0.5 inches (1.27 centimeter) and 1 inch (2.54 inches). In one illustrative embodiment, the outer diameter (OD) of the outer wall 46 is approximately 2.1 inches (5.334 centimeters), and the inner diameter (ID) of the inner wall 48 is approximately 0.72 inches (1.829 centimeters). The inner wall 48 defines an axially extending passage 54 for slidably receiving the outlet hose 24, 24'. An inner surface 56 of the inner wall 48 includes a dual taper. More particularly, upper and lower tapered inner surfaces 56*a* and 56*b* extend radially outwardly from a center portion 57. Each tapered inner surface 56*a*, 56*b* is inclined by an angle $\alpha$ (illustratively equal to 3 degrees) from vertical, which helps the hose weight 30 glide along the hose 24, 24'.

A cap 60 is secured to the shell 44 and defines a second end wall 62. The cap 60 may illustratively be formed of a polymer, although other suitable materials such as metals may be substituted therefor. In one illustrative embodiment, both the shell 44 and the cap 60 are formed of a polymer having a density of between 0.03 lbs. per cubic inch (0.83 grams per cubic centimeter) and 0.09 lbs. per cubic inch (2.491 grams per cubic centimeter). In one illustrative embodiment, the polymer of the shell 44 and the cap 60 is a molded acetal having a density of approximately 0.04 lbs. per cubic inch (1.107 grams per cubic centimeter).

The filler 42 is received within the chamber 52 and illustratively comprises a metallic material. In certain illustrative embodiments, the filler 42 is a granular material. Alternatively, the filler 42 may be solid, such as sintered steel or lead.

In certain illustrative embodiments, the filler 42 comprises a plurality of metallic particles or grains 64. More particularly, the filler 42 may comprise steel shot includes a plurality of grains 64 having a density of between 0.09 lbs. per cubic inch (2.491 grams per cubic centimeter) and 0.37 lbs. per cubic inch (10.242 grams per cubic centimeter). In certain illustrative embodiments, the filler 42 comprises steel shot including grains 64 having a density between 0.25 lbs. per cubic inch (6.92 grams per cubic centimeter) and 0.37 lbs. per cubic inch (10.242 grams per cubic centimeter).

Figure 7A:
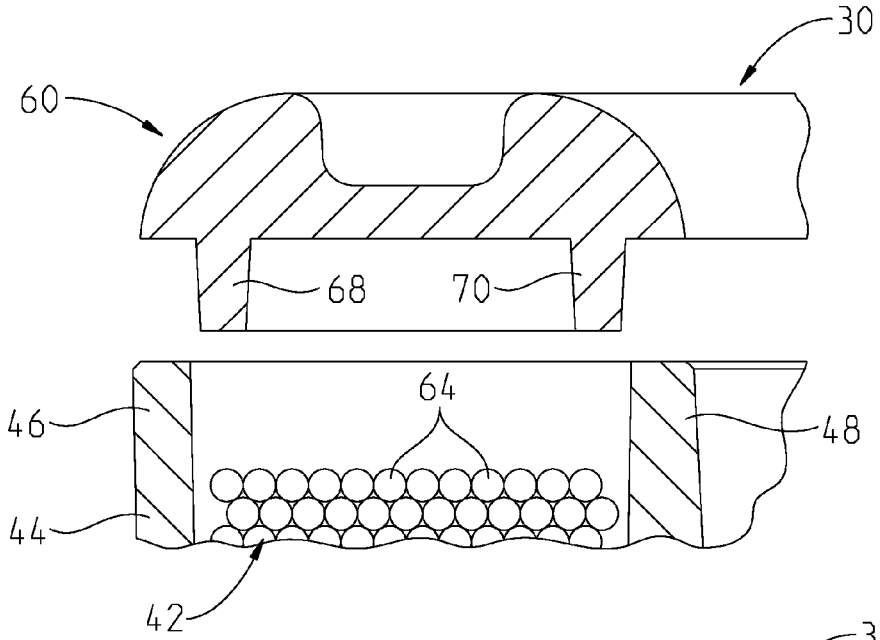
FIGS. 7A-7C are cross-sectional views illustrating a method of securing the cap to the shell of the hose weight of FIG. 3.
Figure 7B:
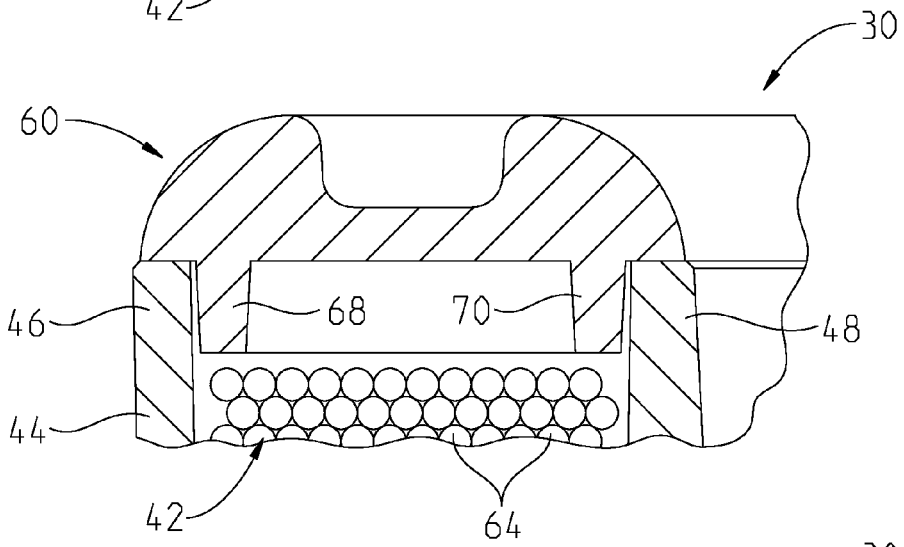
Figure 7C:
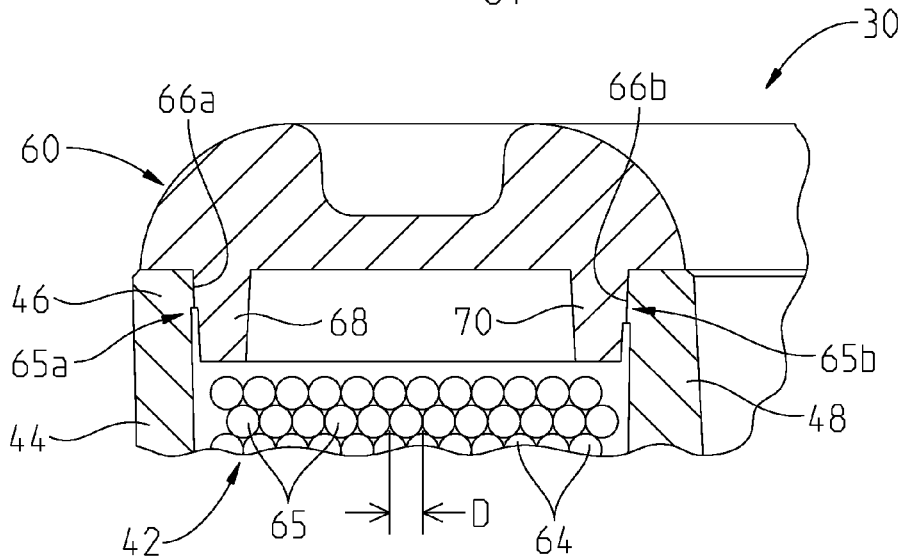
Figure 8:
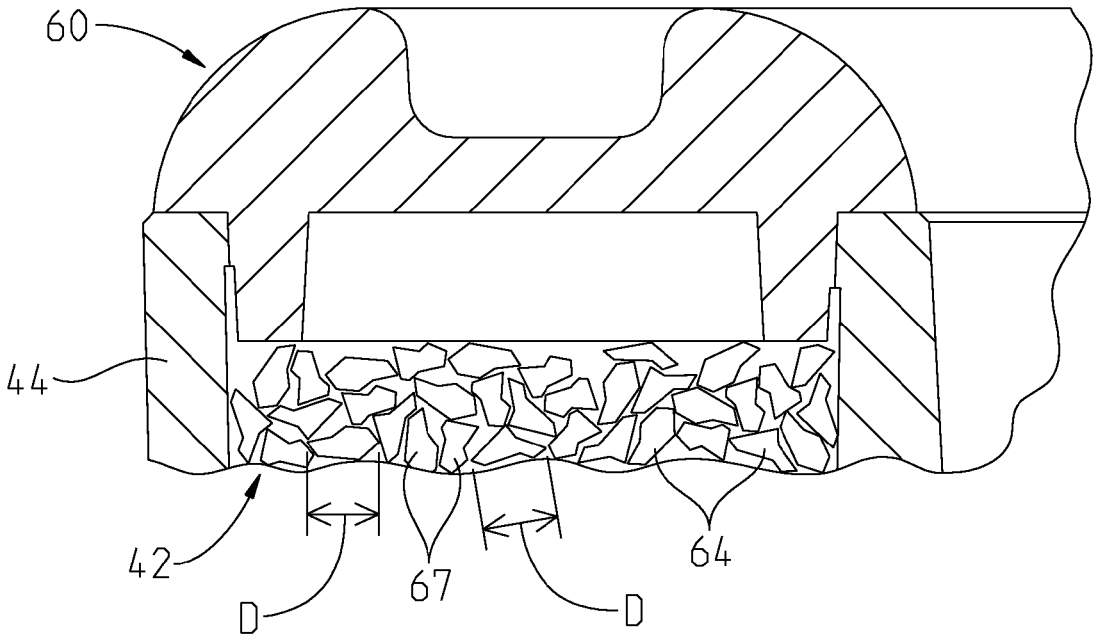
FIG. 8 is a cross-sectional view similar to FIG. 7C, showing further illustrative grains of the hose weight filler material.

As shown in FIG. 7C, each grain 64 may comprise a substantially spherical ball 65 illustratively having a major dimension (D) defined by the outer diameter of the ball 65. Alternatively, as shown in FIG. 8, each grain 64 may have an irregularly shaped body 67 having a major dimension (D), defined as the greatest linear distance between opposing outer surfaces.

In certain illustrative embodiments, the filler 42 may comprise various combinations of different types of steel shot. For example, the filler 42 may comprise at least one of S-330, S-390 and S-460 steel shot. More particularly, the filler 42 in one illustrative embodiment includes a mixture of S-330 and S-460 steel shot.

Illustratively, the hose weight 30 has a total weight between approximately 0.5 lbs. (0.227 kilograms) and 1 lb. (0.454 kilograms). In one illustrative embodiment, the outer housing 40 has a weight of approximately 0.05 lbs. (0.023 kilograms) and the filler 42 has a weight of approximately 0.55 lbs.+/−0.05 lbs. (0.249 kilograms+/−0.023 kilograms), such that the hose weight 30 has a total weight of approximately 0.6 lbs.+/−0.05 lbs. (0.272 kilograms+/−0.023 kilograms).

The cap 60 is illustratively secured to the shell 44 through shear joints 65*a* and 65*b* defined by ultrasonic welds 66*a* and 66*b*. Alternatively, the shear joints 65*a* and 65*b* may be formed through spin welding. More particularly, an outer mounting ring 68 of the cap 60 is secured to an inner surface of the outer wall 46 of the shell 44, and an inner mounting ring 70 of the cap 60 is secured to an outer surface of the inner wall 48 of the shell 44. Alternatively, the cap 60 may be secured to the shell 44 through other conventional means, such as adhesives, heat staking, brazing, or fasteners, including a threaded connection.

With further reference to FIGS. 7A-7C, an illustrative method of securing the cap 60 to the shell 44 is shown, using ultrasonic energy to join together thermoplastics. The ultrasonic welds 66*a* and 66*b* define the pair of shear joints or interference joints 65*a* and 65*b*. Initial contact is limited to small areas between the inner surface of the outer wall 46 of the shell 44 and the outer surface of the outer mounting ring 68 of the cap 60, and between the outer surface of the inner wall 48 of the shell 44 and the inner surface of the inner mounting ring 70 of the cap 60 (FIG. 7B). These contacting surfaces melt first.

As the shell 44 and the cap 60 telescope together, they continue to melt along the vertical walls 46, 68 and 48, 70. Welding is accomplished by first melting the small, initial contact area and then continuing to melt with a controlled interference along the vertical walls 46, 68 and 48, 70 as the shell 44 and the cap 60 telescope together (FIG. 7C). The smearing action of these two melt surfaces eliminates leaks and voids, forming a seal therebetween. More particularly, an effective seal is obtained as the molten area of the interface is prevented from coming into contact with the surrounding air.

Figure 9:
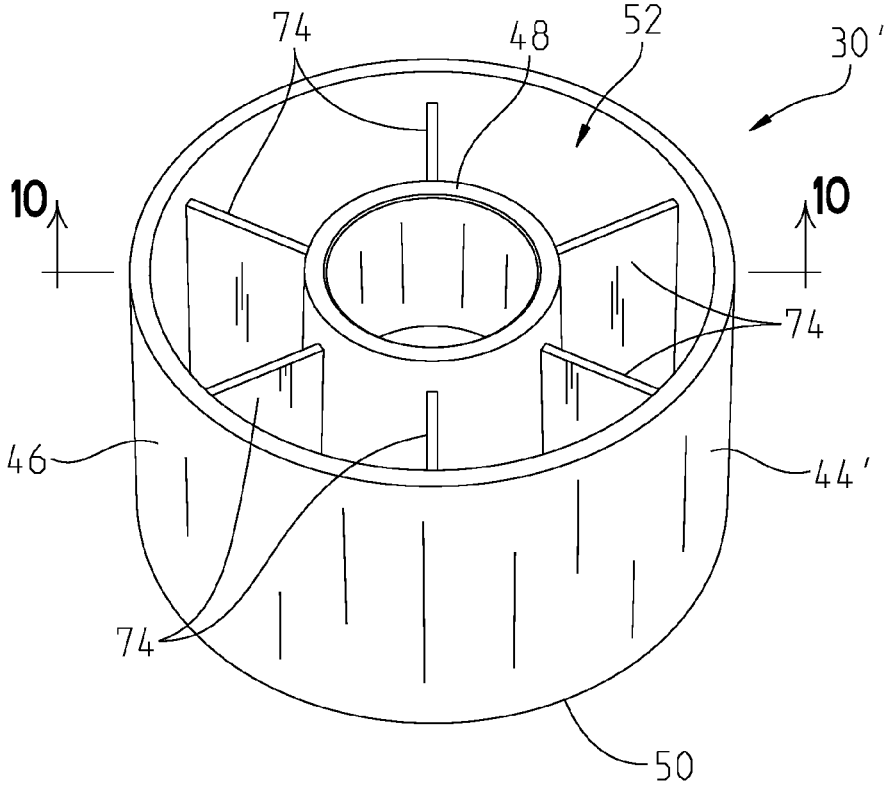
FIG. 9 is a perspective view of a further illustrative shell of a hose weight.
Figure 10:
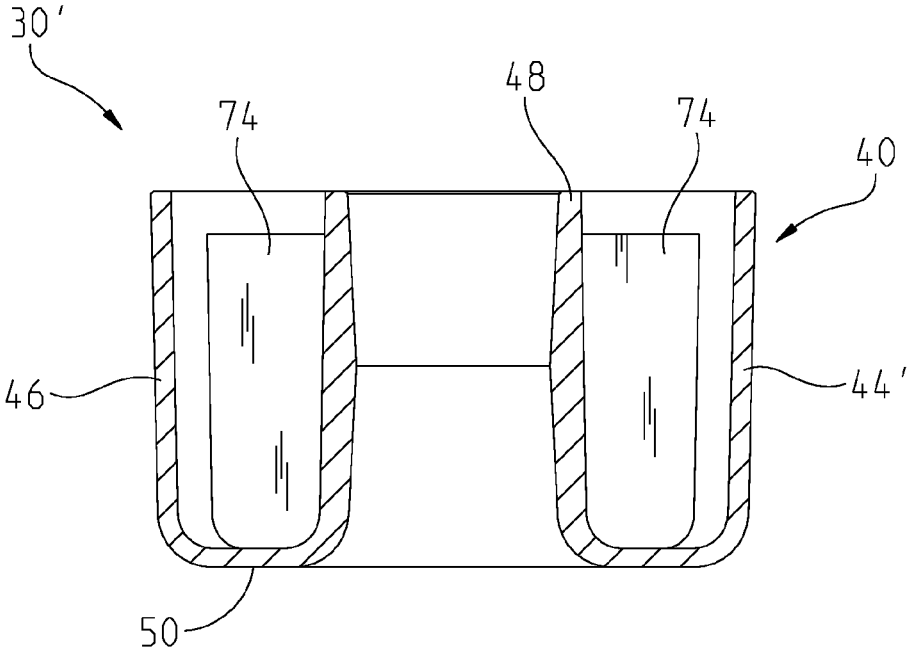
FIG. 10 is a cross-sectional view taken along line 10-10 of FIG. 9.

FIGS. 9 and 10 illustrative a further illustrative embodiment hose weight 30' where the shell 44' includes a plurality of circumferentially spaced ribs 74. The ribs 74 extend radially within the chamber 52 between the outer wall 46 and the inner wall 48. The ribs 74 provide added strength to the shell 44 and may also assist in the assembly process. For example, the ribs 74 may provide added strength to the shell 44 during the process of securing (e.g., welding) the cap 60 to the shell 44.

Although the invention has been described in detail with reference to certain preferred embodiments, variations and modifications exist within the spirit and scope of the invention as described and defined in the following claims.

The invention claimed is:

1. A hose weight assembly comprising:

a faucet outlet hose fluidly coupled to a dispensing unit of a faucet, the faucet outlet hose defining a loop;

an outer housing including a shell, the shell having an outer wall, an inner wall, a first end wall, and a chamber defined between the outer wall, the inner wall and the first end wall, and a cap secured to the shell and defining a second end wall;

wherein the outer wall is cylindrical, the inner wall is cylindrical, and the chamber is annular, the inner wall defining a passage slidably receiving the faucet outlet hose; and a filler received within the chamber, the filler comprising a granular material having grains each with a major dimension of between 0.005 inches and 0.079 inches.

2. The hose weight assembly of claim 1, wherein the granular material is steel shot having a major dimension of between 0.028 inches and 0.079 inches.

3. The hose weight assembly of claim 2, wherein the granular material is at least one of S-70, S-330, S-390 and S-460 steel shot.

4. The hose weight assembly of claim 1, wherein the shell and the cap are formed from a polymer.

5. The hose weight assembly of claim 4, wherein a shear joint secures the cap to the shell.

6. The hose weight assembly of claim 5, wherein the shear joint includes an ultrasonic weld.

7. The hose weight assembly of claim 1, wherein the cap includes a center opening aligned with the passage defined by the inner wall.

8. The hose weight assembly of claim 7, wherein the cap includes an outer mounting ring and an inner mounting ring, the outer mounting ring secured to an inner surface of the outer wall of the shell, and the inner mounting ring secured to an outer surface of the inner wall of the shell.

9. The hose weight assembly of claim 1, wherein the inner wall has a 3 degree taper from the center to the first end wall and a 3 degree taper from the center to the second end wall.

10. The hose weight assembly of claim 1, wherein the outer housing has a density less than 0.05 lbs. per cubic inch, and the filler has a density greater than 0.25 lbs. per cubic inch.

11. A hose weight assembly comprising:

a faucet outlet hose fluidly coupled to a dispensing unit of a faucet, the faucet outlet hose defining a loop;

an outer housing including a shell formed of a polymer, the shell having a cylindrical outer wall, a cylindrical inner wall, a first end wall, and an annular chamber defined between the cylindrical outer wall, the cylindrical inner wall and the first end wall, the inner wall defining a passage slidably receiving the faucet outlet hose, and a cap formed of a polymer, the cap secured to the shell and defining a second end wall, the cap including a center opening aligned with the passage defined by the inner wall, and the polymer having a density between 0.03 lbs. per cubic inch and 0.09 lbs. per cubic inch; and a filler received within the chamber, the filler comprising a metallic material having a density between 0.09 lbs. per cubic inch and 0.37 lbs. per cubic inch.

12. The hose weight assembly of claim 11, wherein the metallic material is steel shot having a major dimension of between 0.028 inches and 0.079 inches.

13. The hose weight assembly of claim 12, wherein the metallic material is at least one of S-70, S-330, S-390 and S-460 steel shot.

14. The hose weight assembly of claim 11, wherein the shell and the cap are molded from acetal.

15. The hose weight assembly of claim 11, wherein a shear joint secures the cap to the shell.

16. The hose weight assembly of claim 15, wherein the shear joint includes an ultrasonic weld.

17. The hose weight assembly of claim 11, wherein the outer wall has an outer diameter of between 2 inches and 2.5 inches, and the inner wall has an inner diameter of between 0.5 inches and 1 inch.

18. The hose weight assembly of claim 11, wherein the inner wall has a 3 degree taper from the center to the first end wall and from the center to the second end wall.

19. The hose weight assembly of claim 11, wherein the faucet outlet hose is coupled to one of a faucet side sprayer and a faucet pull-out sprayhead.

20. The hose weight assembly of claim 11, wherein the cap includes an outer mounting ring and an inner mounting ring, the outer mounting ring secured to an inner surface of the outer wall of the shell, and the inner mounting ring secured to an outer surface of the inner wall of the shell.

* * * * *